US011248628B2

(12) United States Patent
Brown et al.

(10) Patent No.: US 11,248,628 B2
(45) Date of Patent: Feb. 15, 2022

(54) ELECTRIC SUBMERSIBLE PUMP (ESP) GAS SLUG MITIGATION SYSTEM

(71) Applicant: Halliburton Energy Services, Inc., Houston, TX (US)

(72) Inventors: Donn J. Brown, Broken Arrow, OK (US); David C. Beck, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 88 days.

(21) Appl. No.: 16/685,221

(22) Filed: Nov. 15, 2019

(65) Prior Publication Data

US 2021/0148380 A1 May 20, 2021

(51) Int. Cl.

| | |
|---|---|
| ***F04D 29/60*** | (2006.01) |
| ***F04D 13/10*** | (2006.01) |
| ***F04D 9/00*** | (2006.01) |
| ***E21B 43/38*** | (2006.01) |
| ***F04D 29/64*** | (2006.01) |
| ***E21B 41/00*** | (2006.01) |
| ***F04D 13/02*** | (2006.01) |
| ***F04D 29/42*** | (2006.01) |
| ***F04D 29/70*** | (2006.01) |
| *E21B 43/12* | (2006.01) |

(52) U.S. Cl.

CPC ..... *F04D 29/605* (2013.01); *E21B 41/00* (2013.01); *E21B 43/38* (2013.01); *F04D 9/003* (2013.01); *F04D 13/021* (2013.01); *F04D 13/10* (2013.01); *F04D 29/4293* (2013.01); *F04D 29/648* (2013.01); *F04D 29/708* (2013.01); *E21B 43/128* (2013.01); *F05D 2250/51* (2013.01); *F05D 2260/601* (2013.01)

(58) Field of Classification Search

CPC ..... F04D 29/605; F04D 29/648; F04D 13/10; F04D 13/021; F04D 13/08; F04D 13/086; F04D 13/12; F04D 13/14; F04D 1/00; F04D 29/4293; F04D 9/003; E21B 41/00; E21B 43/124; E21B 43/128; E21B 43/122; E21B 43/38; E21B 43/12; E21B 34/06; G04F 1/44; F04B 17/03; F04B 47/06; F04B 53/06; F04B 53/16

See application file for complete search history.

(56) References Cited

U.S. PATENT DOCUMENTS 4,981,175 A * 1/1991 Powers ..... B01D 19/0052 166/265
5,845,709 A * 12/1998 Mack ..... F04D 29/5806 166/302

(Continued)

OTHER PUBLICATIONS

Wellhead "https://en.wikipedia.org/wiki/Wellhead" (Year: 2010).*

(Continued)

*Primary Examiner* — Dominick L Plakkoottam
*Assistant Examiner* — Christopher J Brunjes
(74) *Attorney, Agent, or Firm* — Conley Rose, P.C.; Rodney B. Carroll

(57) ABSTRACT

An electric submersible pump assembly. The electric submersible pump assembly comprises an electric submersible pump comprising a pump intake and a tubing configured to provide continuous fluid communication between a discharge side of the electric submersible pump and the pump intake.

23 Claims, 6 Drawing Sheets

(56) References Cited

U.S. PATENT DOCUMENTS 5,888,053 A * 3/1999 Kobayashi ..... F04D 29/4266 417/244
6,135,210 A * 10/2000 Rivas ..... E21B 41/02 166/105.5
6,394,183 B1 * 5/2002 Schrenkel ..... E21B 43/38 166/265
6,698,521 B2 * 3/2004 Schrenkel ..... E21B 43/38 166/369
7,841,395 B2 11/2010 Gay et al.
10,034,067 B1 * 7/2018 Palmgren, III ..... H04Q 9/00
10,378,322 B2 8/2019 Ejim et al.
2002/0134554 A1 9/2002 Schrenkel et al.
2003/0192702 A1 * 10/2003 Gay ..... E21B 43/128 166/373
2009/0159262 A1 * 6/2009 Gay ..... E21B 43/128 166/105
2010/0108307 A1 * 5/2010 Brown ..... E21B 43/124 166/105.5
2011/0017459 A1 * 1/2011 Dinkins ..... E21B 37/00 166/310
2014/0377080 A1 * 12/2014 Xiao ..... F04B 47/06 417/53
2016/0130923 A1 * 5/2016 Nowitzki ..... E21B 43/128 166/66.4
2016/0333681 A1 * 11/2016 Mazzanti ..... E21B 43/38

OTHER PUBLICATIONS

Definition—Valve: McGraw-Hill Dictionary of Engineering, Second Edition (Year: 2003).*
Foreign Communication from Related Application—International Search Report and Written Opinion of the International Searching Authority, International Application PCT/US2019/061991, dated Jul. 22, 2020, 11 pages.

* cited by examiner

ELECTRIC SUBMERSIBLE PUMP (ESP) GAS SLUG MITIGATION SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubblepoint, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Gas entering an electric submersible pump (ESP) can cause various difficulties for a centrifugal pump. In an extreme case, the ESP may become gas locked and become unable to pump fluid. In less extreme cases, the ESP may experience harmful operating conditions when transiently passing a slug of gas. When in operation, the ESP rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the ESP may heat up rapidly and undergo significant wear, shortening the operational life of the ESP, thereby increasing operating costs due to more frequent change-out and/or repair of the ESP. In some operating environments, for example in some horizontal wellbores, gas slugs that persist for at least 10 seconds are repeatedly experienced. Some gas slugs may persist for as much as 30 seconds or more. The present disclosure teaches directing (also referred to as returning, recycling, recirculating, or pumping around) a portion of the fluid exiting the discharge of the ESP back to the pump intake, for example through a tube extending from a location downstream of the pump to a location upstream of the pump proximate the pump intake to provide a continuous flow of fluid to both cool and lubricate the ESP in the event of a gas slug entering the ESP and to reduce the risk that the ESP will become gas locked. This recirculation of a portion of the discharge fluid mitigates the deleterious effects of gas slugs on the ESP. In some contexts, a pump intake may be referred to as a pump inlet and an intake may be referred to as an inlet.

Figure 1:
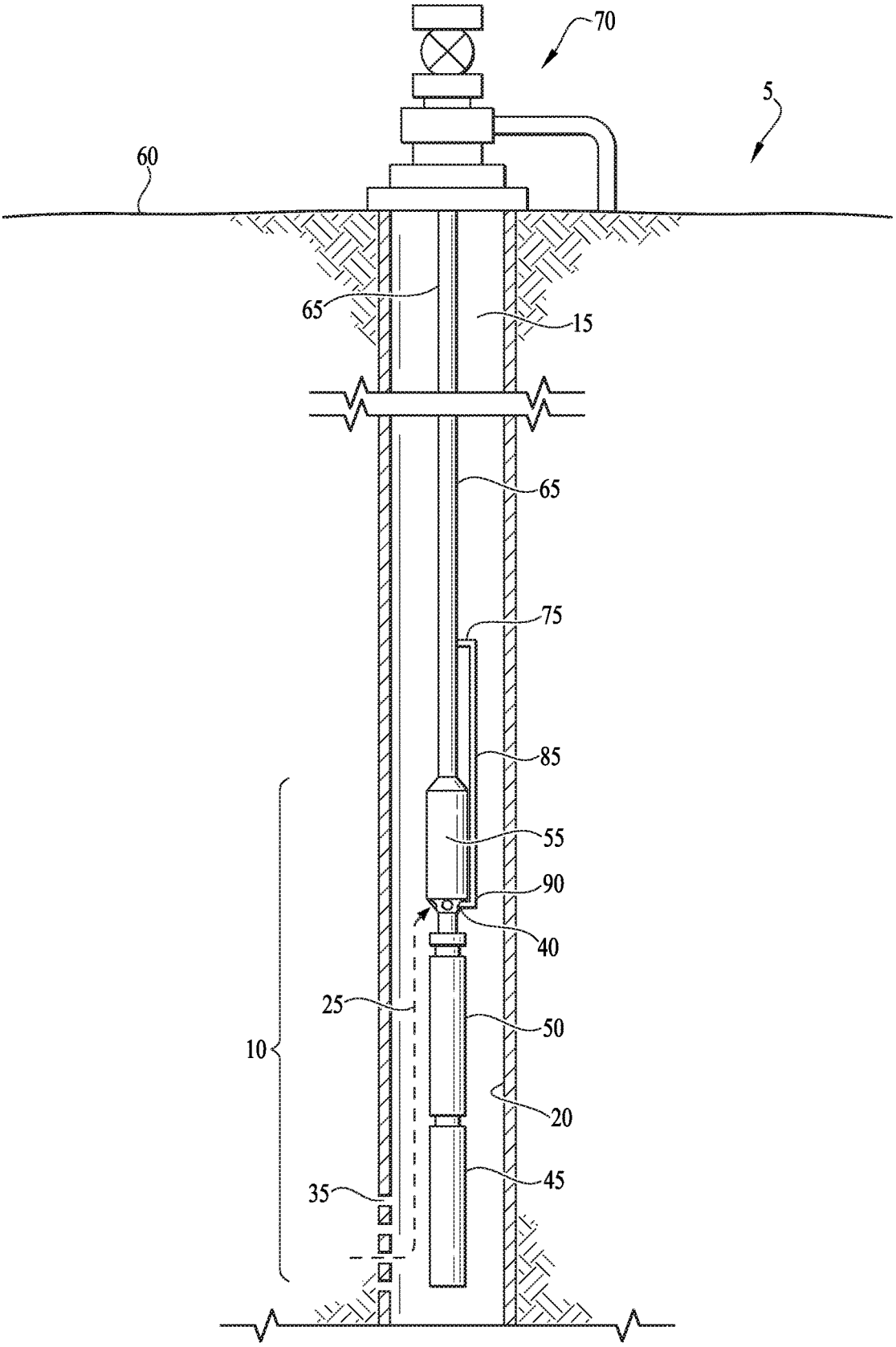
FIG. 1 is an illustration of an electric submersible pump (ESP) assembly according to an embodiment of the disclosure.

Turning now to FIG. 1, a production system 5 comprising an electric submersible pump (ESP) assembly 10 is described. The ESP assembly 10 is shown disposed in a wellbore 15 within well casing 20. In an embodiment, the ESP assembly 10 comprises an electric motor 45, a seal unit 50, a pump intake 40, and a centrifugal pump 55. A discharge of the pump 55 is coupled to a production tubing 65 that extends upwards to a wellhead 70 disposed at the surface 60. In an embodiment, an upper end of a tubing 85 (also referred to as recirculation, return, recycle, or pump around tubing 85) is coupled to a port or other opening in the production tubing 65, and an exit 90 of the tubing 85 is positioned and/or directed proximate (e.g., into) a port of the pump intake 40. In an embodiment, the tubing 85 may be strapped to the production tubing 65 and/or strapped to the pump 55. In an embodiment, the tubing 85 is coupled between a discharge side of the ESP assembly (e.g., a discharge side of the centrifugal pump 55) and the pump intake 40. In an embodiment, the tubing 85 is in fluid communication with the discharge side of the ESP assembly and with the pump intake.

Reservoir fluid 25 enters the wellbore 15 through perforations 35 of the casing 20, flows into the pump intake 40, and is pumped by the centrifugal pump 55 to achieve a higher pressure at a discharge of the pump 55. Some of the reservoir fluid 25 that exits the discharge of the pump 55 flows to the wellhead 70 via production tubing 65. Some of the reservoir fluid 25 that exits the discharge of the pump 55 enters a port 75 that fluidly couples the production tubing 65 and/or the discharge of the pump 55 to the tubing 85 and flows via the tubing 85 to the exit 90 and reenters the pump intake 40. In some contexts, the flow of fluid from the production tubing 65 into the port 75 through the tubing 85 and out the exit 90 into the pump intake 40 may be substantially continuous.

In an embodiment, the wellbore 15 may comprise a horizontal or deviated production zone below the pump intake 40 that may produce gas slugs that continue for at least 10 seconds or longer on a repeating basis. In an embodiment, the casing 20 may have a small inside diameter, presenting a tight hole for the ESP assembly 10. Without limitation, in some wellbores 15, the casing 20 may have an outside diameter of from about 5½ inches to about 4½ inches (having an inside diameter from about 4.8 inches to about 3.8 inches, respectively). The reservoir fluid 25 may comprise a mix of liquid and gas. The reservoir fluid 25 may comprise occasional gas slugs, for example gas slugs that last at least 10 seconds. The fluid in the tubing 85 may be referred to as recirculation fluid (or alternatively recycle fluid or pump around fluid) in some contexts. The recirculation fluid may comprise a mix of liquid and gas.

It is noted that even if the recirculation fluid that enters the pump intake 40 from the tubing 85 contains entrained gas, this recirculation fluid may still provide beneficial cooling and lubricating effects to the bearing surfaces of the centrifugal pump 55. By continuously introducing the recirculation fluid from the tubing 85 into the pump intake 40, the risk of the centrifugal pump 55 becoming gas locked is reduced or eliminated. The continuous flowing of recirculation fluid from the tubing 85 into the pump intake 40 pre-empts a condition of the pump losing lubrication (e.g., becoming dry), getting hot, and wearing precipitously before a temporary gas slug passes. When it is said that tubing 85 provides continuous fluid flow this assumes that the ESP assembly 10 is operating under normal conditions. For example, if an extremely long duration gas slug is experienced—for example a gas slug that lasts longer than 60 seconds—the continuous flow of fluid from the tubing 85 may be interrupted, but a gas slug that last longer than 60 seconds is not a normal operating condition for the ESP assembly 10. Likewise, if the ESP assembly 10 is operated in a dry wellbore 15, where no reservoir fluid and no gas are present, the tubing 85 may not provide a continuous flow of fluid, but operating the ESP assembly 10 in a dry hole is not a normal operating condition.

In an embodiment, the centrifugal pump 55 may be an overstaged pump. The centrifugal pump 55 (e.g., overstaged pump) may comprise extra stages of impeller/diffuser combinations whereby to produce an increased flow and/or pressure differential to sustain both the desired flow rate of production fluid to the wellhead 70 as well as to sustain the flow of recirculation fluid to the pump intake 40.

Figure 2A:
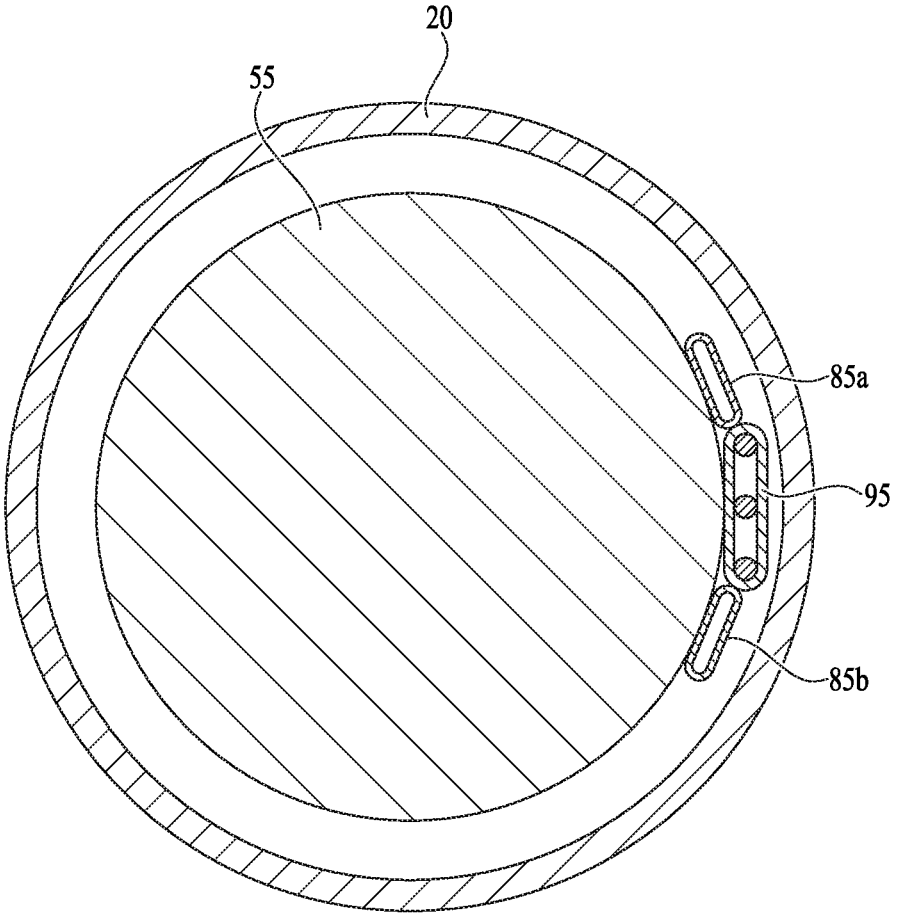
FIG. 2A is a cross-section of an ESP assembly in a wellbore according to an embodiment of the disclosure.

Turning now to FIG. 2A, further details of the tubing 85 are described. The casing 20, the centrifugal pump 55, the tubing 85, and a motor lead extension (MLE) 95 are shown in cross-section according to an embodiment. In an embodiment, the tubing 85 is implemented as two separate tubes 85*a*, 85*b*, whereby to make the cross-section of the tubing 85*a*, 85*b* thinner and better able to fit in the annulus between the casing 20 and the centrifugal pump 55, for example in a tight hole when using slimline casing. In an embodiment, the tubing 85 and/or the tubings 85*a*, 85*b* are elongated in cross-section to provide a lower profile along the side of the ESP assembly 10. In some contexts, the elongated cross-section of the tubing 85 may be referred to as oblong or oval in cross-section. The cross-section of tubing 85 may be curved, for example having a radius of curvature about equal to that of the exterior surface of pump 55 such that tubing 85 fits closely against the exterior surface of pump 55. Said in other words, the side of the tubing 85 closest to the exterior surface of pump 55 may be convex. The tubing 85 may be strapped to the pump 55, for example strapped to a housing or the exterior surface of the pump 55.

The tubing 85 may extend in parallel to the MLE 95. The tubing 85 may be located in close proximity to the MLE 95 whereby to be, at least in part, protected from mechanical damage by the MLE 95. For example, the MLE 95 may comprise an armored exterior to protect its interior electrical lines from mechanical damage from impacts with the casing 20 or with shoulders of artifacts in the wellbore 15. The tubing 85 may be strapped to the pump 55 proximate to and/or beside the MLE 95. If the tubing 85 is thinner in cross section than the MLE 95 and located abutted against the MLE 95, the MLE 95 may block impacts between the casing 20 with the tubing 85. Without limitation, the MLE 95 may be from about ¼ inch thick to about ½ inch thick. In an embodiment, where casing diameter is ample, a round electric cable may be used rather than the MLE 95 to provide electric power to the electric motor 45.

Figure 2B:
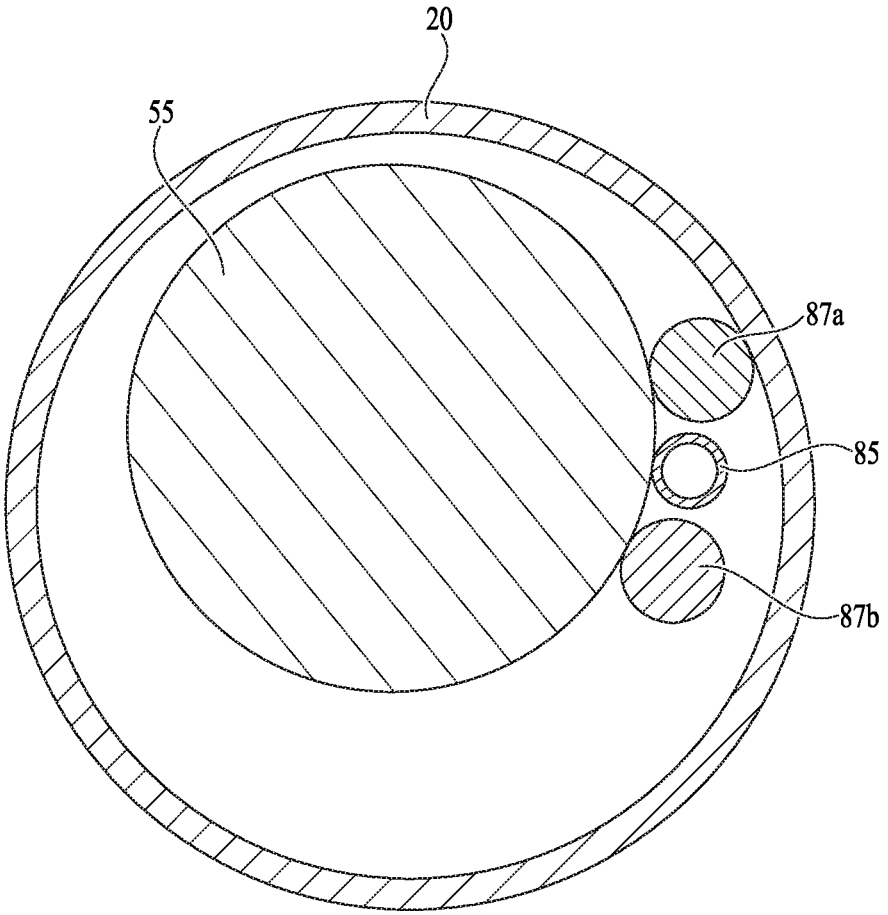
FIG. 2B is a cross-section of an ESP assembly in a wellbore according to an embodiment of the disclosure.

Turning now to FIG. 2B, an aspect of the ESP assembly 10 is described. In an aspect, one or more solid rods are located proximate to the tubing 85 and extending substantially parallel to the tubing 85. For example, the solid rod or rods may be strapped along with the tubing 85 to the pump 55. The solid rod or rods may be welded or spot welded to the pump 55. The solid rod or rods may provide crush protection for the tubing 95, for example to prevent the tubing 85 being crushed by contact with the casing 20 or with an obstruction in the wellbore 15. Crushing the tubing 85 may reduce or block the flow of recirculation fluid through the tubing 85 to the exit 90 and into the pump intake 40.

As shown in FIG. 2B, in an embodiment, a first solid rod 87*a* and a second solid rod 87*b* are located on either side of the tubing 85 and proximate to the tubing 85. The solid rods 87*a*, 87*b* extend substantially parallel to the tubing 85. While illustrated as substantially circular in cross-section in FIG. 2B, the tubing 85 may alternatively be shaped as discussed above with reference to FIG. 2A.

The solid rod or rods 87 may have a diameter that is about equal to or greater than the thickness of the tubing 85. When the ESP assembly 10 contacts the casing 20 or other obstruction in the wellbore 15, the mechanical force of contact may be absorbed and resisted by the solid rod or rods 87, preventing the mechanical force of contact from crushing the tubing 85. As illustrated in FIG. 2B, the first solid rod 87*a* is in contact with the casing 20 and is absorbing the mechanical force of contact between the ESP assembly 10 and the casing 20. The first solid rod 87*a* is preventing the mechanical force of contact with the casing 20 from possibly crushing the tubing 85, thereby mitigating or blocking flow of recirculation fluid through the tubing 85, out of the exit 90, into the pump intake 40 where the lack of recirculation fluid might otherwise cause damage to the centrifugal pump during an event of a gas slug entering the pump intake 40. The solid rod or rods 87 may be formed of metal, for example out of metal bar stock. In an aspect, the solid rod or rods 87 may extend along the entire length of the centrifugal pump 55. In another aspect, the sold rod or rods 87 may extend along a portion of but not all of the centrifugal pump 55. In an embodiment, a single solid rod 87 is provided as part of the ESP assembly 10. In another embodiment, two solid rods 87*a*, 87*b* are provided as part of the ESP assembly 10. In another embodiment, three solid rods 87 are provided as part of the ESP assembly 10, for example a first solid rod 87 located on one side of the first tubing 85*a*, a second solid rod 87 located between the first tubing 85*a* and the second tubing 85*b*, and a third solid rod 87 located on another side of the second tubing 85*b*.

With reference now to both FIG. 1, FIG. 2A, and FIG. 2B, further details of the tubing 85 are described. The tubing 85 may be constructed of stainless steel tubing or other metal that is resistant to chemical corrosion. In some cases, the reservoir fluid 25 may comprise corrosive chemicals. In an embodiment, an interior of the tubing 85 may be treated to be abrasion resistant or abrasion tolerant, for example to reduce the risk of a failure of the ESP assembly 10 because of failure of the tubing 85 resulting from erosion of the interior of the tubing 85. In some cases, the reservoir fluid, and hence the recirculation fluid flowing in the tubing 85, may entrain abrasive particles such as formation sands and/or fracking proppants. In an embodiment, an abrasion resistant coating may be applied to the center of the tubing 85. In an embodiment, an abrasion resistant layer may be formed on the interior of the tubing 85 through a process using electrolysis and an appropriate fluid circulated through the inside of the tubing 85. In an embodiment, the tubing 85 may be formed of hardened steel or may be treated after formation by a steel hardening process, for example to make the interior of the tubing 85 abrasion resistant or abrasion tolerant.

The inside diameter of the tubing 85 may be scaled to provide a desired throttling effect on flow of the recirculation fluid. Because the discharge pressure of the pump 55 may be significantly greater than the intake pressure of the pump 55, unthrottled flow of recirculation fluid may result in releasing recirculation fluid into the pump intake 40 with too high a rate of flow, which may damage the intake or lower pump stages through erosion induced by high flow rate of recirculation fluid with entrained solids. Additionally, too high a flow rate of recirculation fluid in the tubing 85 may cause undesired rapid erosion inside the tubing 85. Alternatively, the port 75 may be scaled to provide the desired throttling effect.

In an embodiment, the percent of fluid discharged by the pump 55 that is flowed to the tubing 85 as recirculation fluid may vary depending on well conditions, pump flow rate, expected gas to liquid ratio, gas slug size, and/or gas slug time duration. In examples the percent of fluid discharged by the pump 55 that is flowed to the tubing 85 as recirculation fluid may range from 5 percent to 45 percent. In other examples, however, the percent of fluid discharged by the pump 55 that is flowed to the tubing 85 as recirculation fluid may not be limited to that range. In an aspect, the percent of fluid discharged by the pump 55 that is flowed to the tubing 85 as recirculation fluid may be about 1 percent, about 2 percent, about 3 percent, about 4 percent, about 5 percent, about 7 percent, about 10 percent, about 12 percent, about 15 percent, about 18 percent, about 20 percent, about 23 percent, about 25 percent, about 28 percent, about 30 percent, about 35 percent, about 40 percent, about 45 percent, or about 50 percent.

The port 75 may be located proximate the top of the pump 55, for example proximate to a discharge of the pump 55. The port 75 may be located downstream of the discharge of the pump 55. In an embodiment, the port 75 may be located less than 1 foot, less than 2 feet, less than 3 feet, less than 4 feet, less than 5 feet, less than 8 feet, less than 10 feet, less than 12 feet, less than 15 feet, or less than 30 feet above (e.g., downstream) the discharge of the pump 55. In an embodiment, the port 75 may be coupled to a manifold component located between the discharge of the pump 55 and the downhole end of the production tubing 65. In an embodiment, the port 75 may be located at a point in the wall of the pump 55 intermediate between the first stage of the pump 55 (e.g., the stage closest to the pump intake 40) and the last stage of the pump 55.

The exit 90 may provide the desired throttling function described above. If either the port 75 or the exit 90 provides the desired throttling function, the port 75 and/or the exit 90 may be made of abrasion resistant material, for example made of a carbide material, made of tungsten, or made of another abrasion resistant material. The exit 90 may be configured to direct recirculation fluid into a port or opening in the pump intake 40. In an embodiment, the exit 90 may extend into and beyond the surface opening of the port in the pump intake 40. In an embodiment, the exit 90 may be coupled to a wall of the pump 55 at a downhole location of the pump 55, for example proximate to a first stage of the pump 55.

Figure 3:
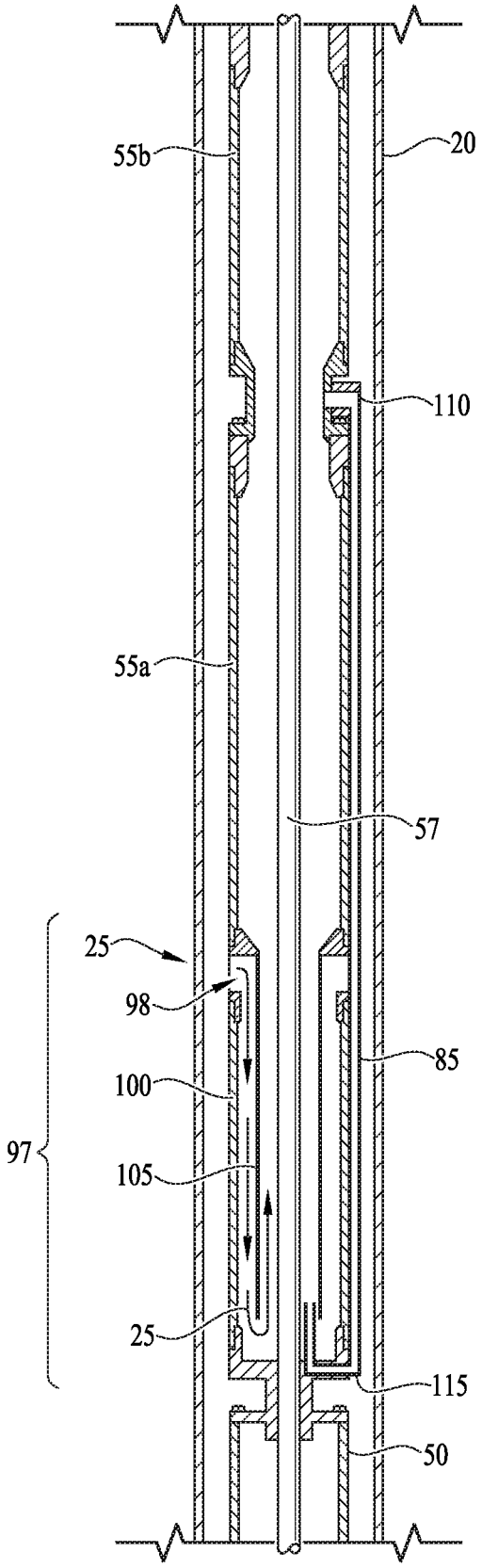
FIG. 3 is an illustration of a portion of an ESP assembly according to an embodiment of the disclosure.

Turning now to FIG. 3, an alternative embodiment of the ESP assembly 10 is described. In an embodiment, the ESP assembly 10 comprises a reverse flow intake 97 in place of or playing the role of the pump intake 40 shown in FIG. 1. The reverse flow intake 97 provides a gravity gas separation system, for example an inverted shroud. It is understood that the reverse flow intake 97 may take a variety of different forms and is not limited to the form illustrated in FIG. 3. FIG. 3 illustrates a drive shaft 57 that extends from the electric motor 45, through the seal section 50, and into the pumps 55*a*, 55*b*. In an embodiment, the drive shaft 57 may comprise a plurality of separate shafts that are mechanically coupled to one another, for example using splined couplings. The drive shaft 57 may transfer mechanical torque generated by the electric motor 45 to turn the impellers in the pumps 55*a*, 55*b*.

In some contexts, the reverse flow intake 97 may be referred to as or be considered to be the pump intake 40. The reverse flow intake 97 comprises an outer wall 100 and an inner sleeve 105. The outer wall 100 defines a plurality of intake ports 98. A top of the inner sleeve 105 is closed to radial flow of fluid from its outside to its inside. In operation, the reservoir fluid 25 flows up along the outside of the outer wall 100, into the intake ports 98, reverses direction and flows down a first annulus defined between the outer wall 100 and the inner sleeve 105, and again reverses direction to flow up a second annulus defined between the inner sleeve 105 and a drive shaft of the ESP assembly 10. The bottom of the inner sleeve 105 allows flow between the first annulus and the second annulus. By reversing direction at intake ports 98, and again at the bottom of the inner sleeve 105 gas entrained in the reservoir field 25 may be reduced and released up the wellbore 15 outside of the reverse flow intake 97. The reverse flow intake 97 can be used in a single pump configuration (for example, combined with the single pump shown in FIG. 1) or can be used with a multi-pump configuration such as shown in FIG. 3 and described in more detail herein.

The ESP assembly 10 in FIG. 3 comprises a first centrifugal pump 55*a* and a second centrifugal pump 55*b*. A port 110 may be fluidly coupled to a discharge of the first pump 55*a* and the tubing 85, for example at a location proximate to or downstream from the discharge of pump 55*a*. In an aspect, the port 110 may be located a distance equal to or less than about 0.1, 0.5, 1, 1.5, 2, 2.5, 3, 3.5, 4, 4.5, 5, 6, 7, 8, 9, or 10 feet from the outlet of pump 55*a*. An outlet or exit 115 of the tubing 85 is plumbed into the reverse flow intake 97 and opens into (e.g., discharges the recirculation fluid into) the second annulus between the inner sleeve 105 and the drive shaft of the ESP assembly 10. In an embodiment, the tubing 85 is coupled between a discharge side of the first centrifugal pump 55*a* and the inner sleeve 105. In an embodiment, the tubing 85 is in fluid communication with the discharge side of the first centrifugal pump 55*a* and with the inner sleeve 105 of the reverse flow intake 97.

In an aspect, the exit 115 is located proximate a lower end or bottom of the first and second annular space, e.g., where fluid 25 turns the corner and changes direction from downward to upward as shown by arrow 25 in FIG. 3. During operation, some (e.g., a first portion) of the reservoir fluid 25 that exits the discharge of the first pump 55*a* flows to the intake of the second pump 55*b*, and the second pump 55*b* discharges this first portion of the reservoir fluid 25 to the production tubing 65, and the production tubing 65 flows that that first portion of reservoir fluid 25 to the wellhead 70. Some (e.g., a second portion) of the reservoir fluid 25 that exits the discharge of the first pump 55*a* enters the port 110 and flows via the tubing 85 (e.g., is recirculated as recirculation fluid) to the exit 115 and reenters the inside of the inner sleeve 105 of the reverse flow intake 97 to return to the first pump 55*a*. The amount of fluid recirculated via tubing 85 (e.g., the second portion) can be equal to or greater than 2, 3, 4, 5, 6, 7, 8, 9, 10, 11, 12, 13, 14, 15, 16, 17, 18, 19, 20, 23, 25, 28, 30, 33, 35, 38, 40, or more than 40 percent by volume. The flow of reservoir fluid 25 through the tubing 85, out the exit 115, and into the inside of the inner sleeve 105 of the reverse flow intake 97 may be substantially continuous or operate at steady-state, e.g., having a continuous and about constant flow rate. The fluid flowing in the tubing 85 may be referred to in some contexts as recirculation fluid.

In an embodiment, the first pump 55*a* may be a tapered pump. The first pump 55*a* may be sized to provide an excess of flow whereby to better supply a desired flow rate comprising both the rate of flow of fluid to the wellhead 70 and the rate of flow through the tubing 85 and back into the interior of the inner sleeve 105. In an embodiment, the first pump 55*a* may be an axial flow pump, and the second pump 55*b* may be a radial flow pump. In an embodiment, the first pump 55*a*, the second pump 55*b*, the port 110, the tubing 85, and the exit 115 may be used in an ESP assembly 10 without the reverse flow intake 97 and configured instead with the intake 40 (e.g., for example as shown in FIG. 1 wherein pump 55 comprises two pump 55*a*, 55*b*). In an embodiment, an ESP assembly 10 may comprise the first pump 55*a* (without the second pump 55*b*), the reverse flow intake 97, the tubing 85 coupled to the production tubing 65 at port 110, and the exit 115 entering the interior of the inner sleeve 105 (e.g., for example as shown in FIG. 3 with second pump 55*b* omitted).

Figure 4A:
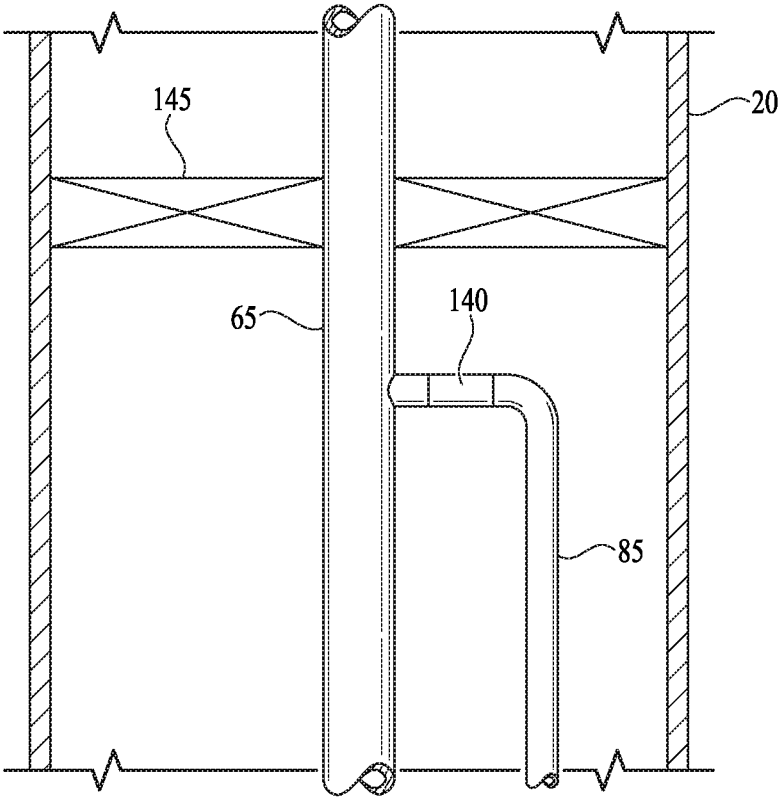
FIG. 4A is an illustration of a production tubing and a recirculation tube according to an embodiment of the disclosure.

Turning now to FIG. 4A, a production system 5 having a packer 145 is described, wherein packer 145 is positioned in an annular space between the production tubing 65 and the casing 20 and is thereby in sealing contact with the outer surface of the production tubing 65 and the inner surface of casing 20. In an embodiment, a packer 145 is installed to isolate the ESP assembly 10 from fluid communication with an uphole portion of the wellbore 15. Gas may collect at the top of the annulus between the casing 20 and the production tubing 65 below the packer 145. In an embodiment, the tubing 85 is coupled to the production tubing 65 through a Venturi 140 and at a location below the packer 145 (e.g., proximate the area where gas may collect at the top of the annulus between the casing 20 and the production tubing 65). As reservoir fluid 25 flows out of the production tubing 65 and into the tubing 85, it passes through a narrowed throat of the Venturi 140 that has a port open to the wellbore (e.g., proximate the area where gas may collect at the top of the annulus between the casing 20 and the production tubing 65). The flow of reservoir fluid 25 through the Venturi narrow throat causes a low pressure point and induces gas that has accumulated in the wellbore 15 below the packer 145 (e.g., gas that has collected at the top of the annulus between the casing 20 and the production tubing 65) to enter the Venturi 140 and to become entrained in the reservoir fluid 25 flowing through the tubing 85 back to the intake to the pump 55. In this way, a controlled amount of gas can be entrained in the reservoir fluid 25 and produced to the wellhead 70, relieving the accumulation of gas below the packer 145. An unabated accumulation of gas below the packer may be undesirable for various reasons. For example, if gas accumulates unabated, the gas may ultimately fill the annulus between the packer 145 and the pump intake to such an extent that reservoir fluid may be separated into a liquid phase and a gas phase, but the segregated gas still enters the pump intake as it has nowhere else to go. This may, if continued, ultimately cause gas lock of the pump 55.

Figure 4B:
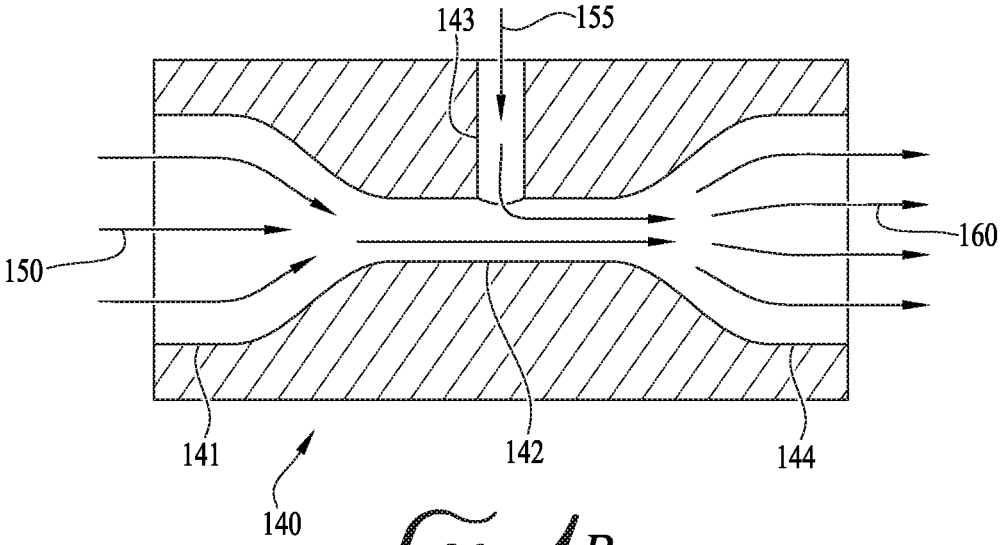
FIG. 4B is an illustration of a Venturi according to an embodiment of the disclosure.

Turning now to FIG. 4B, further details of the Venturi 140 are described. In an embodiment, the Venturi 140 comprises an intake 141 in fluid communication with tubing 85 and/or production tubing 65 (e.g., proximate port 75 and/or port 110), a throat 142, a Venturi port 143 in fluid communication with the wellbore (e.g., proximate the area where gas may collect at the top of the annulus between the casing 20 and the production tubing 65), and an outlet 144 in fluid communication with recirculation tubing 85. As fluid 150 enters the intake 141 and flows to the throat 142 its velocity increases, creating a low pressure at the Venturi port 143. This low pressure area induces gas 155 to enter the Venturi port 143 and to become mixed with and entrained with the fluid 150 as mixed (e.g., gas and liquid) fluid flow 160 that exits the outlet 144.

Figure 5:
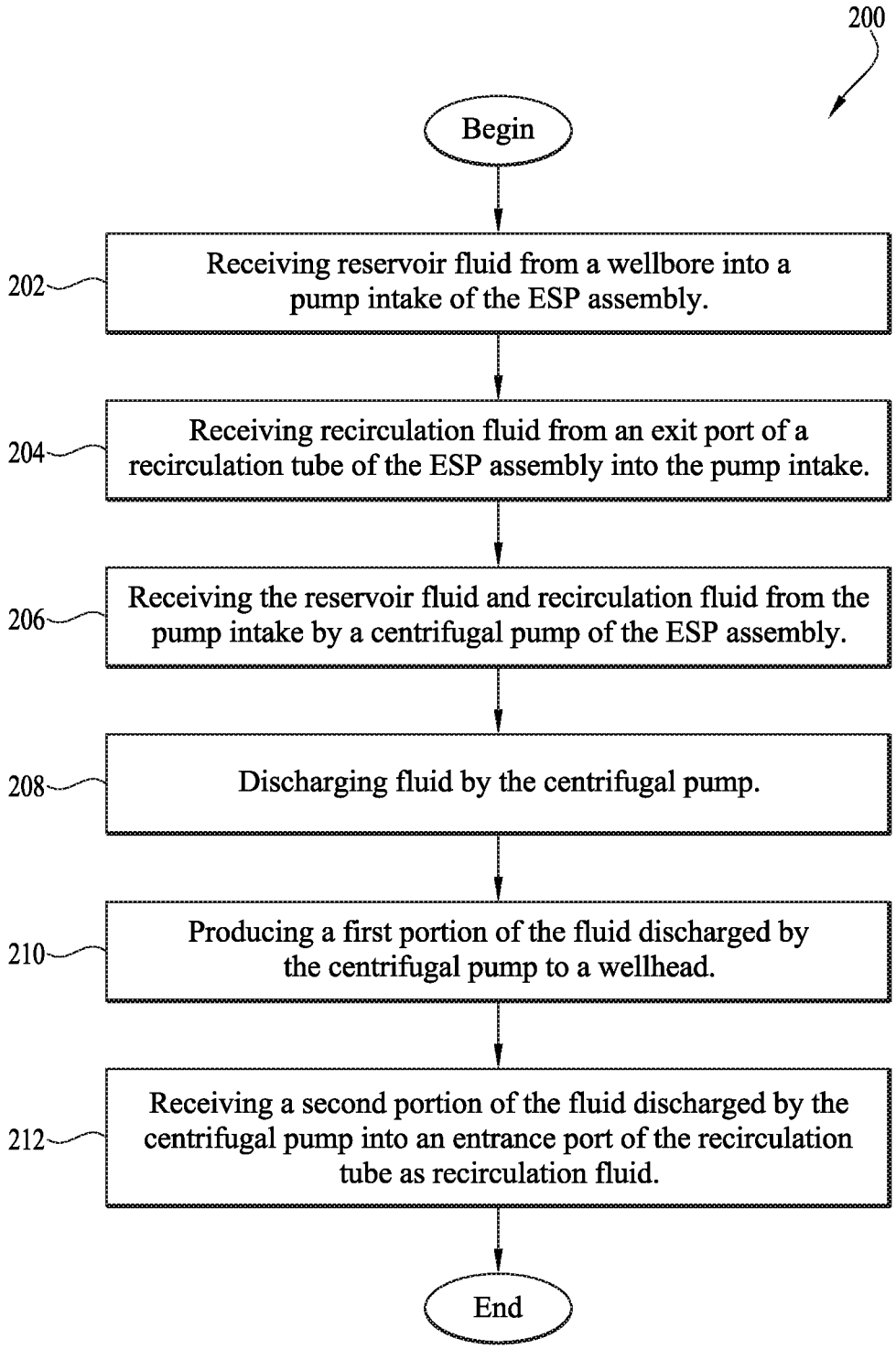
FIG. 5 is a flowchart of a method according to an embodiment of the disclosure.

Turning now to FIG. 5, a method 200 is described. In an embodiment, the method 200 is a method of producing reservoir fluid from a wellbore by an electric submersible pump (ESP) assembly. At block 202, the method 200 comprises receiving reservoir fluid from a wellbore into a pump intake of the ESP assembly. In an embodiment, the reservoir fluid is a mix of liquid and gas. In an embodiment, the reservoir fluid exhibits occasional transient gas slugs that exist at a location proximate the ESP assembly for a duration of time of at least 5, 10, 15, 20, 25, or 30 seconds.

At block 204, the method 200 comprises receiving recirculation fluid from an exit port of a recirculation tube of the ESP assembly into the pump intake. In an embodiment, receiving recirculation fluid from the exit port of the recirculation tube comprises receiving the recirculation fluid into an annulus defined between an inner sleeve of the pump intake and a drive shaft of the ESP assembly. At block 206, the method 200 comprises receiving the reservoir fluid and recirculation fluid from the pump intake by a centrifugal pump of the ESP assembly.

At block 208, the method 200 comprises discharging fluid by the centrifugal pump. At block 210, the method 200 comprises producing a first portion of the fluid discharged by the centrifugal pump to a wellhead. In an embodiment (e.g., in an embodiment that comprises two centrifugal pumps such as pumps 55*a*, 55*b* discussed above with reference to FIG. 3), the action of block 210 comprises receiving the first portion of the fluid discharged by the centrifugal pump by a second centrifugal pump that produces the first portion of the fluid to the wellhead. At block 212, the method 200 comprises receiving a second portion of the fluid discharged by the centrifugal pump into an entrance port of the recirculation tube as recirculation fluid. In an embodiment, the second portion of fluid is a continuous flow or about continuous flow of the fluid discharged by the centrifugal pump. In an embodiment, the method 200 further comprises receiving the first portion of the fluid discharged by the centrifugal pump by a second centrifugal pump, wherein the second centrifugal pump produces the first portion of the fluid to the wellhead.

Without wishing to be limited by theory, a description of different possible gas slug mitigation scenarios are now described. When a slug of gas occurs, the fluid that enters the pump intake from the wellbore 15 comprises a fluid with a high ratio of gas, including, as an extreme limit case, a fluid that is 100 percent gas. During such a gas slug event, without the presence of recirculation fluid received from the exit port of the recirculation tube, the internal bearings of the centrifugal pump dry out quickly, heat up quickly, and begin to wear rapidly. During such a gas slug event, without the presence of recirculation fluid received from the exit port of the recirculation tube, the internal bearings may experience thermal shock caused by rapid heat rise followed by subsequent cooling shock when the liquid again reaches the bearing, and this thermal shock cycle can cause cracking of the metal of the bearings. With the presence of recirculation fluid, however, at least some lubrication is supplied to the internal bearings, the bearings are at least partially cooled, and rapid bearing wear is reduced or prevented. Even if the recirculation fluid flow diminishes as a gas slug event continues for an extended period of time, any recirculation fluid flow will have a mitigating effect by providing some lubrication and some cooling effect and hence some mitigation of rapid bearing wear. Such gas slug transients may happen again and again. Every such event can produce incremental wear which eventually leads to centrifugal pump failure. By mitigating the gas slug events by feeding recirculation fluid into the centrifugal pump, the incremental wear is mitigated and reduced.

Providing the recirculation fluid can mitigate the risk of pump gas lock which may occur when the centrifugal pump receives a fluid having an excessive ratio of gas content. The recirculation fluid adds a liquid rich stream into the gas rich stream, and thereby alters the ratio of gas content in the fluid received by the first stage of the centrifugal pump.

In an embodiment, the method 200 further comprises receiving gas via a Venturi in the recirculation tube from an exterior of the ESP assembly (e.g., from an area proximate where gas may collect at the top of the annulus located below a packer 145 and between the casing 20 and the production tubing 65) and mixing the gas received from the Venturi into the recirculation fluid in the recirculation tube to reduce an amount of gas located in the annulus space in the wellbore below packer 145.

In an aspect, a method comprises pumping, via an electrical submersible pump (ESP) disposed in a wellbore, a reservoir fluid from an intake of the pump to an outlet of the pump and recirculating a portion of the reservoir fluid from a location proximate or downstream of the outlet of the pump back to a location proximate or upstream of the intake of the pump. In an example of this method, the reservoir fluid comprises a slug of gas lasting for a duration of time and the portion of the reservoir fluid recirculated from the outlet of the pump back to the intake of the pump provides cooling, lubrication, or both to the ESP during at least a portion of the duration of time of the slug of gas.

In an aspect, an electrical submersible pump (ESP) assembly configured for use in a wellbore comprises a pump having a pump intake and a pump outlet. an electric motor coupled to and configured to drive the pump, and a recirculation system comprising a fluid intake positioned proximate the pump outlet and a fluid outlet positioned proximate the pump intake, wherein the recirculation system is configured to receive via the fluid intake a recirculated portion of fluid discharged from the pump and recirculate the recirculated portion of the fluid to the pump intake via the fluid outlet. In an example of this ESP assembly of this aspect, the pump outlet is coupled to production tubing and the fluid intake of the recirculation system is in fluid communication with the production tubing at a location downstream from the pump outlet. In another example, the recirculation assembly further comprises a tube extending from the fluid intake to the fluid outlet and providing a flow path for the recirculated portion of the reservoir fluid.

In an aspect, a method of mitigating an effect of a gas slug on operation of an electrical submersible pump (ESP) disposed in a wellbore comprises during all or a portion of a duration of time for which the ESP is subjected to the gas slug, recirculating fluid from a location proximate or downstream of an outlet of the pump to a location proximate or upstream of an intake of the pump.

The teachings herein may provide a number of benefits and advantages for an ESP assembly operating in a downhole environment. ESP assemblies, particularly centrifugal pump components such as bearings, shafts, keys, and keyways, are subject to rapid wear and/or thermal shock when continuous flow of liquid through the centrifugal pump is interrupted as it may during a gas slug event. The use of tubing to provide recirculation fluid at a pump intake can mitigate or prevent this kind of wear or thermal shock, thereby reducing costs of operating an ESP assembly, thereby reducing costs of producing hydrocarbons from a subterranean formation. In addition to this basic feature taught herein, specific features to accomplish this general objective are also taught herein. For example, different tubing cross-section configurations are taught and described. Different tubing cross-section configurations may provide advantages in different downhole environments that may be encountered. Placement of the tubing that provides recirculation fluid so as to mitigate or prevent crushing of the tubing and therefore preventing loss of the advantage of recirculating liquid is taught, for example placement of the tubing proximate to a MLE that protects the tubing from crushing or placement of the tubing proximate to one or more solid bars that protect the tubing from crushing. The prevention of crushing of the tubing providing recirculation fluid provides advantages of making the ESP assembly more robust and helps to secure the advantages of providing recirculation fluid to the pump intake as described above.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

ADDITIONAL DISCLOSURE

The following are non-limiting, specific embodiments in accordance with the present disclosure:

A first embodiment, which is an electric submersible pump (ESP) assembly, comprising an electric submersible pump comprising a pump intake, and a tubing coupled between a discharge side of the electric submersible pump and the pump intake.

A second embodiment, which is the ESP assembly of the first embodiment, wherein the tubing has an oblong cross-section.

A third embodiment, which is the ESP assembly of the first, or the second embodiment, further comprising a solid rod located proximate to the tubing and extending substantially parallel to the tubing.

A fourth embodiment, which is the ESP assembly of the first, the second, or the third embodiment, wherein the tubing comprises two separate tubes that extend in parallel along an outside of the electric submersible pump.

A fifth embodiment, which is the ESP assembly of the first, the second, the third, or the fourth embodiment, wherein the tubing comprises a Venturi installed proximate to an upper end of the tubing.

A sixth embodiment, which is the ESP assembly of the first, the second, the third, the fourth, or the fifth embodiment, wherein an upper end of the tubing is coupled to a production tubing that is coupled to and in fluid communication with the discharge side of the electric submersible pump.

A seventh embodiment, which is the ESP assembly of the first, the second, the third, the fourth, or the fifth embodiment, further comprising a second electric submersible pump having an intake in fluid communication with the discharge side of the electric submersible pump.

An eighth embodiment, which is the ESP assembly of the seventh embodiment, wherein the electric submersible pump is an axial flow pump and the second electric submersible pump is a radial flow pump.

A ninth embodiment, which is the ESP assembly of the first, the second, the third, the fourth, the fifth, or the sixth embodiment, wherein the electric submersible pump is an overstaged pump.

A tenth embodiment, which is an electric submersible pump (ESP) assembly, comprising a first centrifugal pump, a second centrifugal pump having an intake in fluid communication with a discharge side of the first centrifugal pump, a reverse flow intake having a discharge in fluid communication with an intake of the first centrifugal pump, and a tubing coupled between a discharge side of the first centrifugal pump and an inner sleeve of the reverse flow intake.

An eleventh embodiment, which is the ESP assembly of the tenth embodiment, wherein the first centrifugal pump has a higher flow capacity than the second centrifugal pump.

A twelfth embodiment, which is the ESP assembly of the tenth, or the eleventh embodiment, wherein the tubing has an oblong cross-section.

A thirteenth embodiment, which is the ESP assembly of the tenth, the eleventh, or the twelfth embodiment, wherein the tubing extends in parallel with and in close proximity to a motor lead extension (MLE) along an outside of the first centrifugal pump.

A fourteenth embodiment, which is the ESP assembly of the tenth, the eleventh, the twelfth, or the thirteenth embodiment, wherein the reverse flow intake comprises an outer wall that defines a plurality of intake ports located proximate to a top of the reverse flow intake, wherein a top of the inner sleeve of the reverse flow intake is closed to radial flow of fluid from an outside to an inside of the inner sleeve and a bottom of the inner sleeve allows flow between an annulus defined between the outer wall and the inner sleeve and an annulus defined between the inner sleeve and a drive shaft of the ESP assembly, wherein the discharge of the reverse flow intake is in fluid communication with the annulus defined between the inner sleeve and the drive shaft of the ESP assembly, and wherein an exit of the tubing is configured to discharge into the annulus defined between the inner sleeve and the drive shaft of the ESP assembly.

A fifteenth embodiment, which is a method of producing reservoir fluid from a wellbore by an electric submersible pump (ESP) assembly, comprising receiving reservoir fluid from a wellbore into a pump intake of the ESP assembly, receiving recirculation fluid from an exit port of a recirculation tube of the ESP assembly into the pump intake, receiving the reservoir fluid and recirculation fluid from the pump intake by a centrifugal pump of the ESP assembly, discharging fluid by the centrifugal pump, producing a first portion of the fluid discharged by the centrifugal pump to a wellhead, and receiving a second portion of the fluid discharged by the centrifugal pump into an entrance port of the recirculation tube as recirculation fluid.

A sixteenth embodiment, which is the method of the fifteen embodiment, further comprising receiving gas via a Venturi in the recirculation tube from an exterior of the ESP assembly, and mixing the gas received from the Venturi into the recirculation fluid in the recirculation tube.

A seventeenth embodiment, which is the method of the fifteen, the sixteenth embodiment, further comprising receiving the first portion of the fluid discharged by the centrifugal pump by a second centrifugal pump, wherein the second centrifugal pump produces the first portion of the fluid to the wellhead.

An eighteenth embodiment, which is the method of the fifteenth, the sixteenth, or the seventeenth embodiment, wherein receiving recirculation fluid from the exit port of the recirculation tube comprises receiving the recirculation fluid into an annulus defined between an inner sleeve of the pump intake and a drive shaft of the ESP assembly.

A nineteenth embodiment, which is the method of the fifteenth, the sixteenth, the seventeenth, or the eighteenth embodiment, wherein the reservoir fluid is a mix of liquid and gas.

A twentieth embodiment, which is the method of the fifteenth, the sixteenth, the seventeenth, the eighteenth, or the nineteenth embodiment, wherein the reservoir fluid exhibits occasional transient gas slugs that exist at a location proximate the ESP assembly for a duration of time of at least 10 seconds.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly, comprising:

a pump intake;

a centrifugal pump coupled to the pump intake;

a discharge coupled to the centrifugal pump;

a Venturi having an inlet, a narrowed throat that has a port defining an opening, and an outlet, wherein the inlet of the Venturi is coupled to a production tubing that is coupled to the discharge and wherein the port of the venturi is configured to draw gas into the venturi from a wellbore; and a tubing coupled at an upper end of the tubing to the outlet of the venturi and directed into the pump intake at a lower end of the tubing.

2. The ESP assembly of claim 1, wherein the tubing has an oblong cross-section.

3. The ESP assembly of claim 1, further comprising a solid rod located proximate to the tubing and extending substantially parallel to the tubing.

4. The ESP assembly of claim 1, wherein the tubing comprises two separate tubes that extend in parallel along an outside of the electric submersible pump.

5. The ESP assembly of claim 1, further comprising a second electric submersible pump having an intake in fluid communication with the discharge side of the electric submersible pump.

6. The ESP assembly of claim 5, wherein the electric submersible pump is an axial flow pump and the second electric submersible pump is a radial flow pump.

7. The ESP assembly of claim 1, wherein the electric submersible pump is an overstaged pump.

8. The ESP assembly of claim 1, wherein the ESP assembly further comprises a motor lead extension (MLE) and the tubing is located abutted against the MLE.

9. The ESP assembly of claim 8, wherein the tubing is strapped to the electric submersible pump.

10. The ESP assembly of claim 1, wherein an interior of the tubing is abrasion resistant.

11. The ESP assembly of claim 1, wherein the lower end of the tubing is made of carbide or is made of tungsten.

12. The ESP assembly of claim 1, wherein the pump intake is a reverse flow intake.

13. An electric submersible pump (ESP) assembly, comprising:

a first centrifugal pump having an intake and a discharge;

a second centrifugal pump having an intake coupled to the discharge of the first centrifugal pump;

a reverse flow intake having a discharge in fluid communication with the intake of the first centrifugal pump; and a tubing coupled at a first end to the ESP assembly, via a Venturi, at a point located between the discharge of the first centrifugal pump and the intake of the second centrifugal pump and coupled at a second end to the ESP assembly at the reverse flow intake, wherein the Venturi has a narrowed throat that has a port defining an opening and the port of the Venturi is configured to draw gas into the venturi from a wellbore.

14. The ESP assembly of claim 13, wherein the first centrifugal pump has a higher flow capacity than the second centrifugal pump.

15. The ESP assembly of claim 13, wherein the tubing has an oblong cross-section.

16. The ESP assembly of claim 13, wherein the tubing extends in parallel with and in close proximity to a motor lead extension (MLE) along an outside of the first centrifugal pump.

17. The ESP assembly of claim 13, wherein the reverse flow intake comprises an outer wall that defines a plurality of intake ports located proximate to a top of the reverse flow intake, wherein a top of the inner sleeve of the reverse flow intake is closed to radial flow of fluid from an outside to an inside of the inner sleeve and a bottom of the inner sleeve allows flow between an annulus defined between the outer wall and the inner sleeve and an annulus defined between the inner sleeve and a drive shaft of the ESP assembly, wherein the discharge of the reverse flow intake is in fluid communication with the annulus defined between the inner sleeve and the drive shaft of the ESP assembly, and wherein an exit of the tubing is configured to discharge into the annulus defined between the inner sleeve and the drive shaft of the ESP assembly.

18. The ESP assembly of claim 13, wherein the tubing comprises an abrasion resistant layer in an interior of the tubing.

19. A method of producing reservoir fluid from a wellbore by an electric submersible pump (ESP) assembly, comprising:

receiving reservoir fluid from the wellbore into a pump intake of the ESP assembly;

receiving a portion of fluid from a production tubing coupled to the ESP assembly by a Venturi intake;

flowing the received portion of the fluid through a narrowed throat of the Venturi;

drawing gas through a port of the Venturi from the wellbore;

entraining the gas drawn from the wellbore with the portion of fluid received by the Venturi;

flowing the gas entrained with the portion of the fluid as a recirculation fluid out of a Venturi outlet into a recirculation tube of the ESP assembly;

receiving the recirculation fluid from an exit port of the recirculation tube of the ESP assembly into the pump intake;

receiving the reservoir fluid and recirculation fluid from the pump intake by a centrifugal pump of the ESP assembly;

discharging fluid by the centrifugal pump; and producing a first portion of the fluid discharged by the centrifugal pump to a wellhead.

20. The method of claim 19, further comprising receiving the first portion of the fluid discharged by the centrifugal pump by a second centrifugal pump, wherein the second centrifugal pump produces the first portion of the fluid to the wellhead.

21. The method of claim 19, wherein receiving recirculation fluid from the exit port of the recirculation tube comprises receiving the recirculation fluid into an annulus defined between an inner sleeve of the pump intake and a drive shaft of the ESP assembly.

22. The method of claim 19, wherein the reservoir fluid is a mix of liquid and gas.

23. The method of claim 19, further comprising, by drawing gas through the port of the Venturi from the wellbore, relieving an accumulation of gas below a packer located in the wellbore above the ESP assembly.

* * * * *